United States Patent [19]

Martin et al.

[11] Patent Number: 4,505,666

[45] Date of Patent: Mar. 19, 1985

[54] STAGED FUEL AND AIR FOR LOW $NO_x$ BURNER

[75] Inventors: Richard R. Martin; Kurt S. Jaeger, both of Tulsa, Okla.

[73] Assignee: John Zink Company, Tulsa, Okla.

[21] Appl. No.: 542,098

[22] Filed: Sep. 28, 1983

Related U.S. Application Data

[63] Continuation of Ser. No. 306,412, Sep. 28, 1981, abandoned.

[51] Int. Cl.[3] ..... F23C 5/28

[52] U.S. Cl. ..... 431/175; 431/10; 431/285

[58] Field of Search ..... 431/10, 12, 174, 175, 431/181, 187, 188, 278, 284, 285, 351, 352; 60/732, 733

[56] References Cited

U.S. PATENT DOCUMENTS

| | | | |
|---|---|---|---|
| 2,263,170 | 11/1941 | Haedike | 431/278 |
| 2,395,276 | 2/1946 | Jordan | 431/174 |
| 2,851,093 | 9/1958 | Zink et al. | 431/174 |
| 3,033,273 | 5/1962 | Zink et al. | 431/174 |
| 3,376,098 | 4/1968 | Pryor | 431/12 |
| 3,873,671 | 3/1975 | Reed et al. | 423/235 |
| 3,911,083 | 10/1975 | Reed et al. | 423/235 |
| 3,925,002 | 12/1975 | Verdouw | 431/10 |
| 4,004,875 | 1/1977 | Zink et al. | 431/9 |
| 4,033,725 | 7/1977 | Reed et al. | 431/5 |
| 4,089,639 | 5/1978 | Reed | 431/211 |
| 4,095,929 | 6/1978 | McCartney | 431/284 |
| 4,157,890 | 6/1979 | Reed | 431/187 |
| 4,162,140 | 7/1979 | Reed | 431/284 |
| 4,244,325 | 1/1981 | Hart et al. | 122/4 |
| 4,245,980 | 1/1981 | Reed et al. | 431/182 |
| 4,257,763 | 3/1981 | Reed | 431/188 |
| 4,395,223 | 7/1983 | Okigami et al. | 431/10 |

FOREIGN PATENT DOCUMENTS 74929 6/1977 Japan .

OTHER PUBLICATIONS

Low $NO_x$ Burner Two Stage Fuel Supply System, Hitachi, Zosen, Jul. 1978, No. D-14B, 6 pages, 345 Park Ave., New York, N.Y. 10022, U.S.A., Jul. 1978.

*Primary Examiner*—Carroll B. Dority, Jr.

*Attorney, Agent, or Firm*—Head, Johnson & Stevenson

[57] ABSTRACT

A low $NO_x$ burner for a furnace and a method of operating the burner involving a primary and secondary combustion zone wherein staged fuel and air to both combustion zones is provided. By injection of from about 40 to 60% of the liquid or gaseous hydrocarbon fuel along with about 90% of the total air required to a first reaction zone and injection of the remaining fuel with the remaining 10% of the air to a secondary reaction zone the formation of $NO_x$ is significantly suppressed. Such a burner is useful in minimizing $NO_x$ emissions for a variety of furnace types including both natural draft and forced draft furnaces.

4 Claims, 10 Drawing Figures

STAGED FUEL AND AIR FOR LOW $NO_x$ BURNER

This is a continuation application of Ser. No. 306,412, filed Sep. 28, 1981, now abandoned.

BACKGROUND OF THE INVENTION

1. Field of the Invention

This invention relates to a method and apparatus for burning fuel resulting in low $NO_x$ formation. More specifically, this invention relates to a staged fuel and air injection burner.

2. Description of the Prior Art

With the advent of contemporary environmental emission standards being imposed by various governmental authorities and agencies involving ever stricter regulations, methods and apparatus to suppress the formation of oxides of nitrogen during combustion with air are becoming increasingly numerous. Various techniques have been suggested and employed in the design and operation of burners and furnaces to meet those regulations. Thus it is known that to burn a hydrocarbon fuel in less than a stoichiometric concentration of oxygen intentionally produces a reducing environment of CO and $H_2$. This concept is utilized in a staged air type low $NO_x$ burner wherein the fuel is first burned in a deficiency of air in one zone producing a reduced environment that suppresses $NO_x$ formation and then the remaining portion of the air is added in a subsequent zone. Staged fuel has also been suggested wherein all of the air and some of the fuel is burned in the first zone and then the remaining fuel is added in the second zone. The presence of an over abundance of air in the first reaction zone acts as a diluent thus lowering the temperature and suppressing formation of $NO_x$. It has also been proposed to recirculate fule gas to accomplish the lowering of the flame temperature.

However, each of the prior art processes have certain inherent deficiencies and associated problems which have led to limited commercial acceptance. For example, when burning fuel in a substoichiometric oxygen environment the tendency for soot formation is increased. The presence of even small amounts of soot will alter the heat transfer properties of the furnace and heat exchanger surfaces downstream from the burner. Also, flame stability can become a critical factor when operating a burner at significantly sub-stoichiometric conditions.

SUMMARY OF THE INVENTION

In view of the problems associated with previously proposed low $NO_x$ burners, we have discovered a method for burning a gaseous or liquid hydrocarbon fuel in air resulting in low $NO_x$ formation comprising the steps of:

(a) burning a portion of the fuel with a major portion of the air in a primary reaction zone such as to reduce the formation of $NO_x$;

(b) directing the effluent from the primary reaction zone into a second reaction zone; and (c) burning the remaining portion of the fuel with the remaining minor portion of the air in the second reaction zone.

Thus, the low $NO_x$ forming burner of the present invention comprises;

(a) a primary reaction zone;

(b) a secondary reaction zone sequentially following the primary reaction zone;

(c) a means for proportioning the fuel between the primary and secondary reaction zones; and (d) a means for supplying a major portion of the air for burning the fuel to the primary reaction zone and supplying the remaining minor portion of the air to the secondary reaction zone.

The present invention further provides for the fuel to be proportioned from about 40 to 60% to the primary reaction zone and then from about 60 to 40% to the second reaction zone while the air is proportioned from about 80 to 95% to the primary zone (preferably 90%) and from about 20 to 5% to the secondary zone (preferably 10%).

The invention further provides for the primary reaction zone to involve at least one injection nozzle within a centrally located chamber and a secondary reaction zone to involve at least one nozzle and preferably a plurality of nozzles surrounding the outlet of the primary reaction zone. Accordingly, the fuel is supplied to the injection nozzles from a single source with the orifices of the nozzles being sized to proportion the fuel between the primary and secondary reaction zones.

It is an object of the present invention to provide a method and apparatus for burning a hydrocarbon fuel resulting in reduced emission of nitrogen oxides generated by the combustion. It is a further object that a two stage fuel and air system be employed in a manner that maintains furnace efficiency without significant soot formation. And, it is an additional object that the method and apparatus be consistent with a variety of burner designs including, for example, flat flame design, round or conical flame burners, high intensity burners and the like. Fulfillment of these objects and the presence and fulfillment of other objects will be apparent upon complete reading of the specification and claims taken in conjunction with the attached drawing.

DESCRIPTION OF THE PREFERRED EMBODIMENTS

Figure 1:
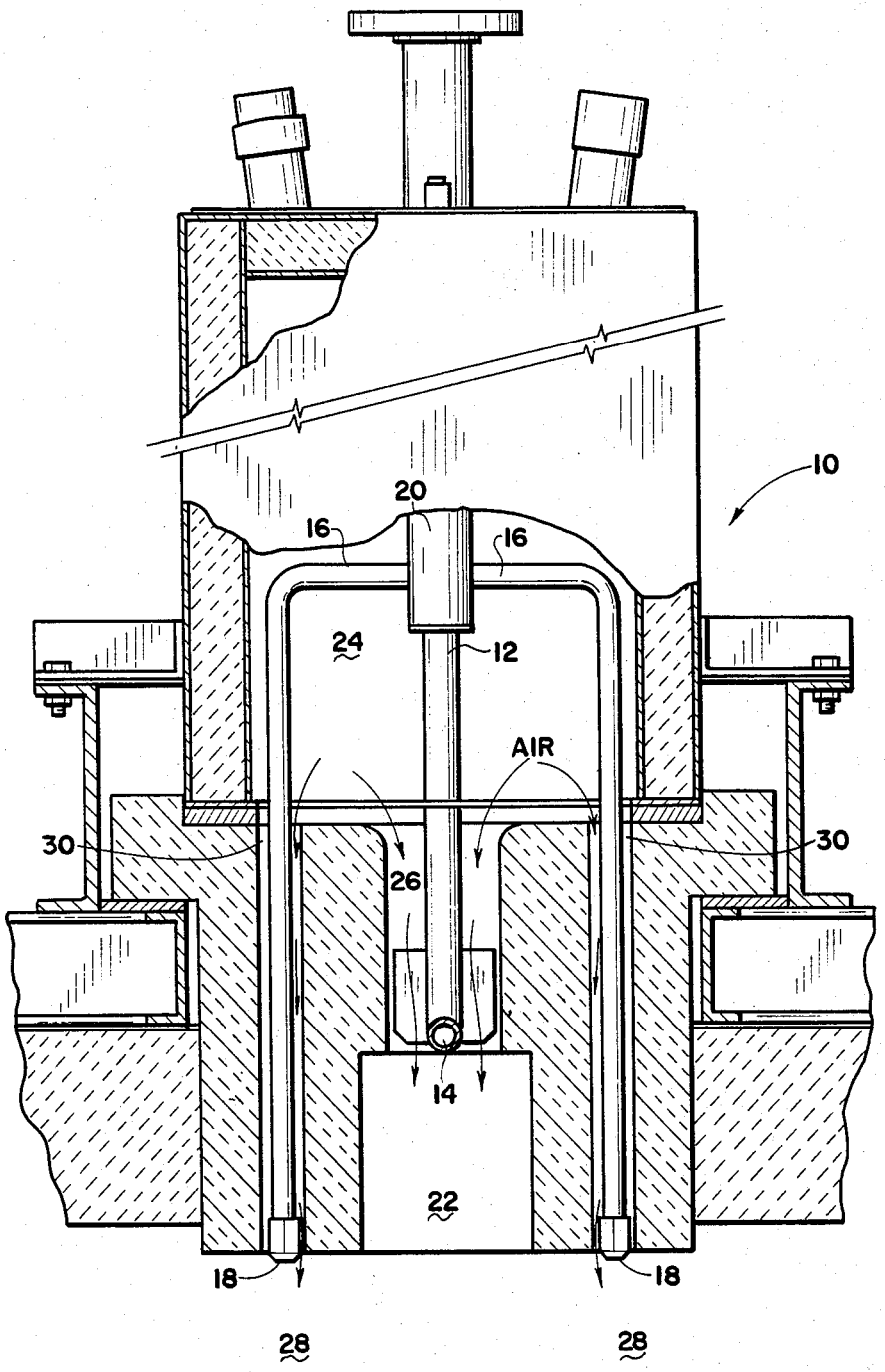
FIG. 1 is a cross-sectional view of one embodiment of the invention illustrating a T-bar primary nozzle and a pair of secondary nozzles.
Figure 2:
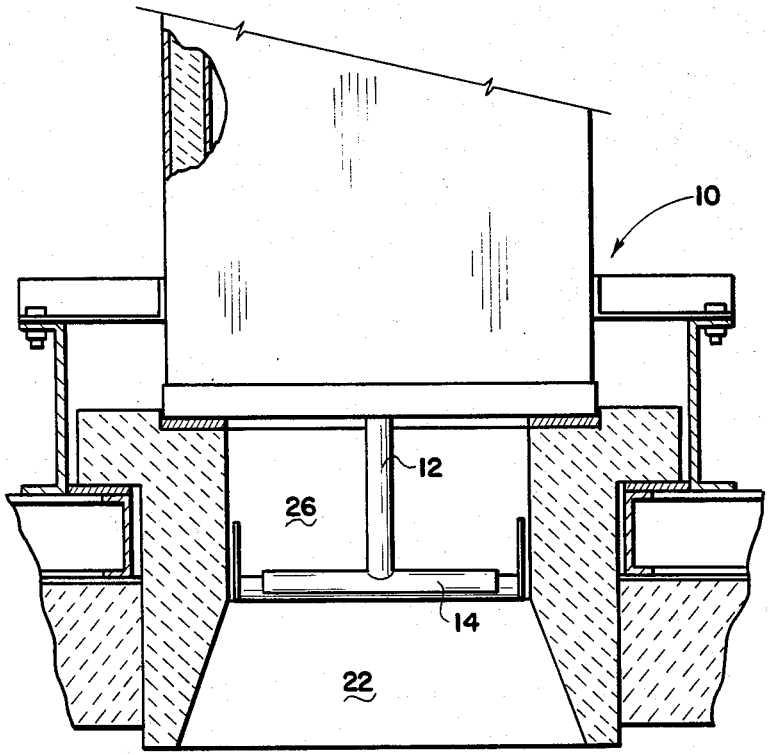
FIG. 2 is a cross-sectional side view of the T-bar primary nozzle of FIG. 1.
Figure 3:
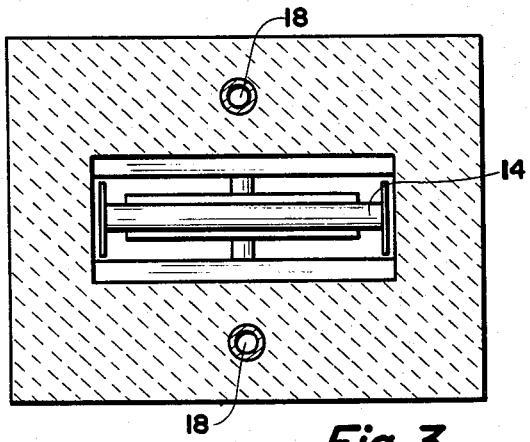
FIG. 3 is an end view of the burner of FIG. 1.

Referring now to the drawing and, in particular, to FIGS. 1, 2 and 3 there is shown one embodiment of the present invention wherein the burner is indicated generally by the numeral 10. This particular embodiment involves a primary burner tube 12 leading to a T-bar primary nozzle 14 along with a pair of secondary burner tubes 16 and secondary burner nozzles 18 all being supplied hydrocarbon fuel from a common source through tube 20. The fuel exiting primary nozzle 14 enters the primary combustion zone 22 wherein it is burned in the presence of a significant stoichiometric excess of air flowing through the interior 24 of the burner and entering the primary reaction zone 22 through an annular space 26 surrounding the primary nozzle 14, as indicated by the presence of arrows.

The effluent from the primary reaction zone 22 enters a larger secondary reaction zone 28. Simultaneously, the fuel exiting the secondary nozzle 18 is mixed with air from the interior 24 of the burner 10 passing through annular conduits 30 surrounding burner tubes 16 and is then burned in the secondary reaction zone 28 in the presence of the effluent from the first reaction zone 22.

The orifices of the respective T-bar nozzle 14 and secondary nozzles 18 are sized such that the fuel is proportioned between the primary reaction zone and the secondary reaction zone. Preferably from about 40 to about 60% of the fuel is directed through the primary nozzle 14 and the remaining fuel is directed to the secondary nozzles 18. Similarly, the cross-sectional area of the annular space 26 and the annular conduits 30 for conducting air to primary and secondary reaction zones are selected such as to deliver about 80 to 95% of the total air to the primary reaction zone 22 and the remaining 20 to 5% of the total air to the secondary reaction zone 28.

Figure 4:
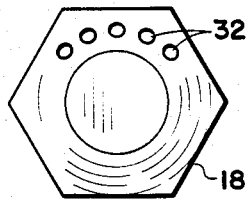
FIG. 4 illustrates the orifice configuration of the secondary nozzles for the burner illustrated in FIG. 1.

FIG. 4 illustrates the directional characteristics of the orifices of each secondary nozzle 18. As illustrated, the five fuel ports 32 will issue a fan like sheet of fuel directed towards the effluent of the primary combustion zone.

Figure 5:
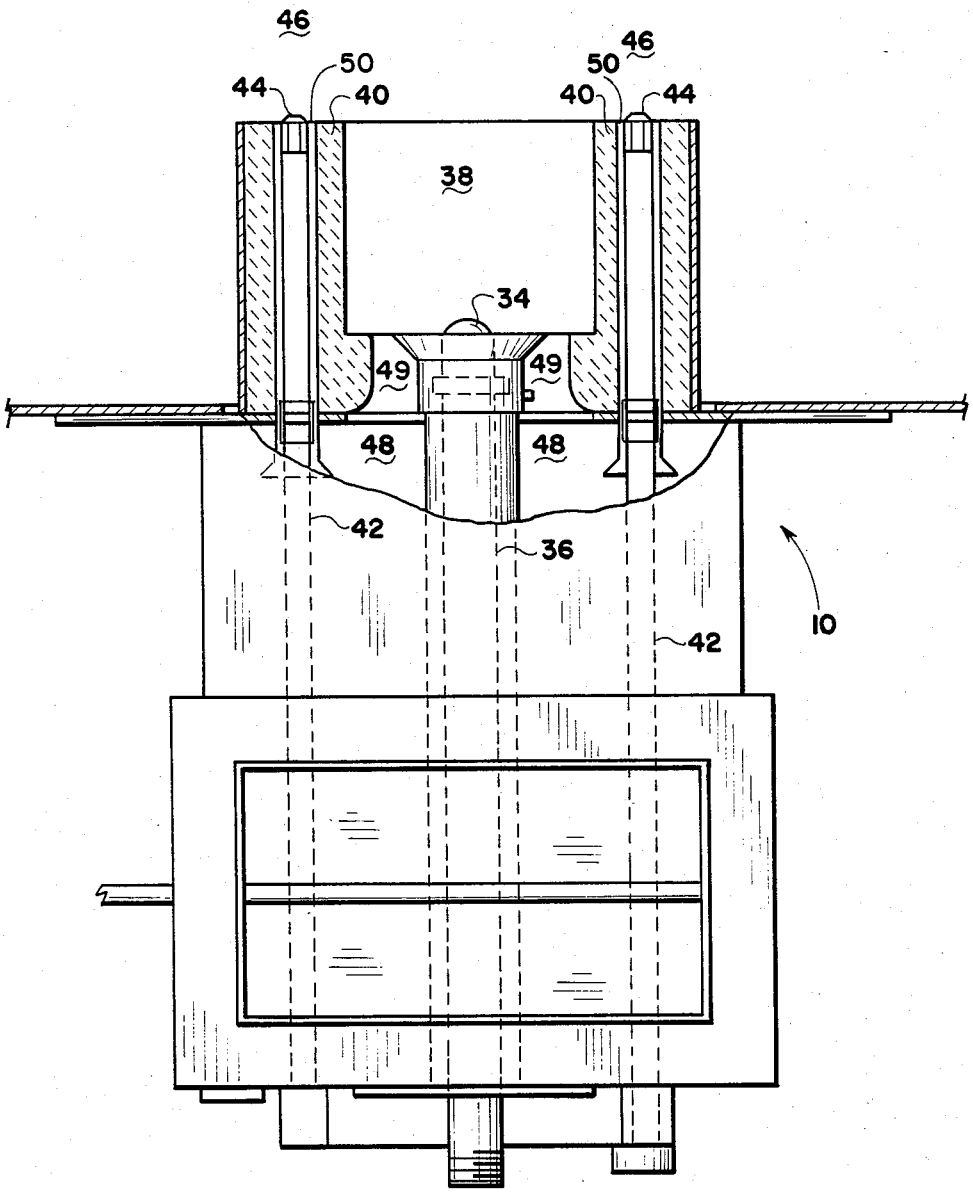
FIG. 5 is a cross-sectional view of an alternate embodiment of this invention illustrating a domed nozzle.
Figure 6:
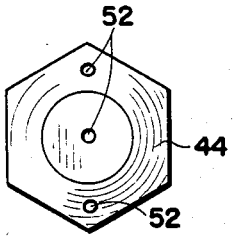
FIGS. 6, 7 and 8 illustrate an alternate secondary nozzle and orifice configuration for burner of FIG. 5.
Figure 7:
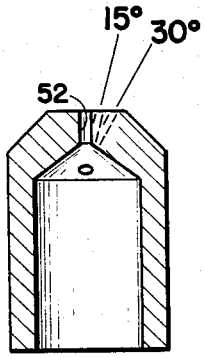
Figure 8:
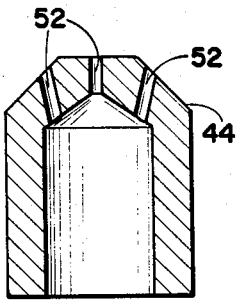

In FIG. 5 an alternate forced draft burner 10 is illustrated involving a single gas nozzle 34 that directs the fuel delivered through conduit 36 into the primary combustion zone 38 defined by the refractory walls 40 of the burner. Riser pipes 42 fitted with orifice tips 44 extend through this refractory wall 40 such as to deliver the secondary fuel to the secondary combustion zone 46. Similar to FIG. 1, combustion air flows through the interior 48 of burner 10 into the primary zone 38 by way of annular conduit 49 and into secondary combustion zone 46 through annular openings 50. FIGS. 6, 7 and 8 illustrate the basic orifice or port configuration 52 of the secondary nozzles 44 including alternate angles of inclination (see FIG. 7) towards the axial direction of the flow in the primary reaction zone 38.

Figure 9:
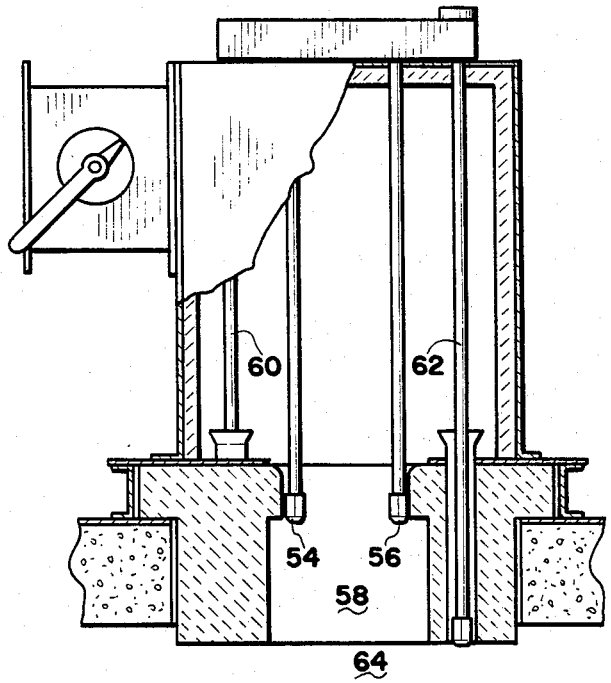
FIG. 9 is another embodiment illustrating a pair of flat flame design primary nozzles.

FIG. 9 illustrates another alternate embodiment of a staged fuel and air burner 10 of the present invention wherein the particular burner is a flat flame design involving a pair of primary nozzles 54 and 56 each essentially adjacent to the refractory walls forming the primary reaction zone 58. Similar to the previous embodiments, secondary fuel conduits 60 and 62 pass through the refractory material such as to deliver fuel to the secondary reaction zone 64.

EXAMPLE

In order to evaluate the principle of separating the gaseous fuel into two essentially equal but sequential burning stages wherein a significant stoichiometric excess or major portion of the air is employed in the first stage with the remaining minor portion of the air in the second stage, a series of tests were conducted using a burner configuration as illustrated in FIG. 5. The burner was of a forced draft design using natural gas. A center mounted gas gun was mounted to fire inside a refractory chamber. Four riser pipes fitted with orifice tips were installed through the refractory wall of the combustion chamber parallel to the center line of the burner. Three sets of tips were tested, each having orifices discharging at different angles to the tip centerline. The burner was tested by firing vertically upward into a furnace.

Three series of tests were conducted; one series for each set of secondary riser tip drillings. The tip drillings included three orifices, and were oriented in the first series discharging vertically upward (parallel to the centerline of the burner), in the second series discharging at a small angle, e.g. 15° off vertical (towards the burner centerline) and in the third series discharging 30° off vertical (towards the burner centerline). Each test series of each set of tips included variations of primary/-secondary fuel ratio and turned down tests.

Figure 10:
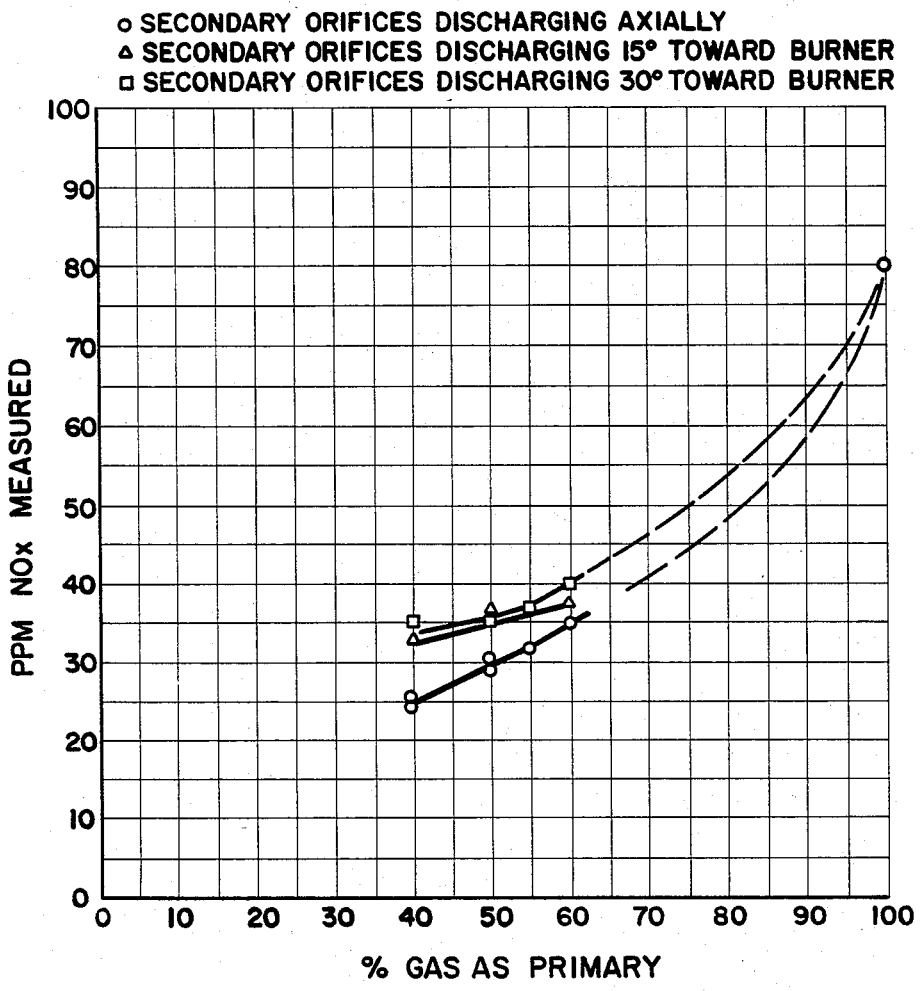
FIG. 10 is a graphic illustration of $NO_x$ levels achieved for a variety of secondary tips and various fuel split ratios.

FIG. 10 illustrates the $NO_x$ levels achieved for each set of tips at various fuel split ratios. The burner was also fired on center gas only to establish the base point for non-staged operation of 80 ppm $NO_x$. The lowest $NO_x$ levels were obtained with secondary orifices discharging parallel to the burner axis, but this set of tips also produces the highest level of combustibles. Turn down on 30° tips was about 3:1 on a fifty/fifty fuel split, and turn down on 15° tips was about 2:1 on a forty/sixty split. Flame appearance was generally good on all arrangements.

From the data and test results it is readily apparent that the basic concept of staged air and fuel combustion is capable of producing $NO_x$ levels significantly lower than conventional combustion. The test results have also established that these low $NO_x$ levels are achieved in the absence of significant soot formation or flame instability. Additional advantages of the present invention include the fact that the $NO_x$ levels achieved are lower than those associated with staged air combustion and the fact that the basic concept of staged air and fuel is compatible with a wide variety of types of burners.

Having thus described the invention with a certain degree of particularity, it is manifest that many changes can be made in the details of construction and arrangement of components without departing from the spirit and scope of this disclosure. Therefore, it is to be understood that the invention is not limited to the embodiment set forth here for purposes of exemplification, but is to be limited only by the scope of the attached claims, including a full range of equivalents to which each element thereof is entitled.

We claim:

1. A low $NO_x$ emission fuel-air burner for a furnace chamber comprising:

an air-fuel mixing and injection burner attached to the wall of said furnace such that the downstream face of said burner terminates substantially adjacent an inner wall of said furnace chamber;

means to supply to said burner, at a given instant of burning, a given total amount of fuel under pressure and a given total amount of air, said total amount of air being at least substantially stoichiometrically sufficient to burn said total amount of fuel supplied to said burner;

means to create a primary reaction burning zone that begins in an enclosed space upstream of said inner wall and extends downstream of said inner wall into said furnace chamber and means to supply to said burning zone a first portion of said total fuel and a portion of said total air which exceeds the stoichiometric requirements for burning said first portion of fuel thereto;

a plurality of conduits in said burner located adjacent said enclosed space, said conduits providing communication between said total air supply and said furnace chamber;

fuel injection nozzle means positioned within each of said conduits such that there is passage of said air thereabout, said nozzle means terminating adjacent said downstream face of said burner;

means to supply the remaining portion of said total fuel to said nozzle means, and means to supply the remaining portion of said total air through said conduits surrounding said nozzle means, said remaining portion of said total air being less than the stoichiometric requirements to burn said remaining portion of said total fuel;

said nozzle means directing said remaining portion of said total fuel as a fan shaped sheet which along with said remaining portion of said total air contributes to the formation of an unconfined secondary reaction burning zone substantially surrounding and reacting with a substantial portion of the unconfined effluent of said primary reaction zone within said furnace chamber, and to cause the inspiration of products of combustion that substantially surround said secondary reaction zone into said secondary reaction zone.

2. A burner of claim 1 including means to supply within the range of about 40 to about 60% of said total fuel to said primary reaction zone and about 60 to about 40% of said fuel being supplied to said secondary reaction zone.

3. A burner of claim 2 including means to supply in the range from about 80 to about 95% of the said total air to said primary reaction zone.

4. A burner of claim 1 including means to supply in the range from about 80 to about 95% of the said total air to said primary reaction zone.

* * * * *